US005710387A

United States Patent [19]

Szalay

[11] Patent Number: 5,710,387

[45] Date of Patent: Jan. 20, 1998

[54] METHOD FOR RECOGNITION OF THE START OF A NOTE IN THE CASE OF PERCUSSION OR PLUCKED MUSICAL INSTRUMENTS

[75] Inventor: Andreas Szalay, Emmelshausen, Germany

[73] Assignee: Yamaha Corporation, Japan

[21] Appl. No.: 585,165

[22] Filed: Jan. 11, 1996

[30] Foreign Application Priority Data

Jan. 12, 1995 [DE] Germany ..... 195 00751.4-51

[51] Int. Cl.[6] ..... G10H 1/02; G10H 5/00

[52] U.S. Cl. ..... 84/663

[58] Field of Search ..... 84/600, 627, 663; 381/39, 40; 395/2.16, 2.18

[56] References Cited

U.S. PATENT DOCUMENTS 4,263,520 4/1981 Kajihata et al. .
4,627,323 12/1986 Gold .
4,829,872 5/1989 Topic et al. ..... 84/615 X
4,841,827 6/1989 Uchiyama .
4,939,471 7/1990 Werbach .
5,048,391 9/1991 Uchiyama et al. ..... 84/654
5,121,669 6/1992 Iba et al. ..... 84/735
5,202,528 4/1993 Iwaooji ..... 84/616
5,223,654 6/1993 Fujita .

*Primary Examiner*—William M. Shoop, Jr.
*Assistant Examiner*—Jeffrey W. Donels
*Attorney, Agent, or Firm*—Graham & James LLP

[57] ABSTRACT

A method is specified for recognition of the start of a note in the case of percussion or plucked musical instruments, in the case of which an envelope curve following function is formed from an audio signal, a comparison variable is formed from a current value of the envelope curve following function and a predecessor value corresponding to an earlier value, and the start of a note is defined at a point in time at which the comparison value exceeds a threshold value.

28 Claims, 2 Drawing Sheets

METHOD FOR RECOGNITION OF THE START OF A NOTE IN THE CASE OF PERCUSSION OR PLUCKED MUSICAL INSTRUMENTS

BACKGROUND OF THE INVENTION

1. Field of the Invention

The invention relates to a method for recognition of the start of a note in the case of percussion or plucked musical instruments.

At the time when synthetic audio or sound production started, musical instruments with keys were mainly used, in the case of which each key was assigned a clearly defined tone. When the key was pressed, not only was the pitch information available, but also the information on the start of a note.

The limitation to musical instruments with keys is, however, unsatisfactory since, in consequence, the range of players who can use the synthetic sound production is greatly limited. For some time, efforts have therefore been made to use the possibilities for synthetic sound production for other musical instruments as well, for example in the case of guitars, basses or other percussion or plucked musical instruments in which the note is produced by striking or plucking a string. However, fundamentally, one is not limited to string instruments in this case. The same problem also occurs in the case of drums and in all other instruments in which excitation is produced by a relatively short pulse and the tone can be varied by varying the structure which oscillates, for example the string length, or the point where the excitation acts. For simplicity, the following explanations are based on a guitar, the method not being limited to guitars.

In the case of guitars, the pitch can be varied, for example, by varying the length of the excited string. The tone can be influenced, for example, by striking the string either closer to the fret or closer to the bridge. As soon as the string oscillates, it is possible to try to obtain the required information in order to make it possible to process it further synthetically. A range of methods are known for determination of the required information. However, all the methods are dependent on the start of excitation, that is to say the start of the note, being identified with sufficient reliability in order that the note recognition algorithm can start to work at all.

The simplest possibility of defining the start of a note is to check whether the audio signal exceeds a predetermined threshold value. As soon as the threshold value is exceeded, it is possible to deduce that a note has started. However, this procedure is inadequate in many cases. A guitarist (even in modern pop music and rock music) would like to have a certain dynamic range available, that is to say they would like to be able to play very loudly as well as very quietly. Although the threshold value will be exceeded when playing loudly, it is possible for the threshold value not to be reached in the case of very quiet notes. Nevertheless, the guitarist is still exciting the string. However, if the start of a note is not defined no further processing takes place either, so that, in the end, no sound can be heard. A further problem is that when playing very quickly, the amplitude of the audio signal frequently no longer drops back below the threshold value, so that the new excitations of the string cannot be determined and evaluated at all. If the threshold value is set very low, cross talk can arise from adjacent strings, so that the start of a note is determined although the string has not been struck or plucked at aft, which likewise leads to incorrect evaluation. In addition, problems result when the guitarist uses a plectrum but this is not placed precisely with its tip on the string but is drawn over the string in a somewhat flatter manner. In this case, certain "initial excitations" occur even before the actual sound which are admittedly likewise periodic and, as a rule, occur one to two octaves higher than the desired note and, although they do not affect the actual note, appear to early.

If the threshold value is now set very low in order also to render quiet notes recognizable reliably, there occur specifically in the last two problem cases incorrect signals which can be overcome again in the subsequent evaluation algorithms only with difficulty. If, in contrast, the threshold value is set too high, the dynamic range for the guitar player is reduced.

The invention is based on the object of reliably determining the start of a note in a wide dynamic range.

SUMMARY OF THE INVENTION

To this end, a method for recognition of the start of a note in the case of percussion or plucked musical instruments is specified, in the case of which an envelope curve following function is formed from an audio signal, a comparison variable is formed from a current value of the envelope curve following function and a predecessor value corresponding to an earlier value, and the start of a note is defined at a point in time at which the comparison value exceeds a threshold value.

The amplitude of the audio signal is thus no longer evaluated per se. Instead of this, a signal derived from the audio signal is initially formed, namely the envelope curve following function. With virtually all percussion or plucked musical instruments, once a note has been excited, it decays with time. The amplitude of the audio signal is thus reduced and the values of the envelope curve following function reduce with time. As a result of the harmonic content which most notes have, this decay is, however, not constant in all cases. Instead of this, particularly at the start of a note, certain overshoots can be observed which lead to the amplitude being temporarily increased. Since the envelope curve following function is intended to be capable of being implemented as simply as possible, a certain amount of ripple is likewise observed here which, from time to time, leads to a rise in the amplitude. However, this rise is particularly severe at the start of a new note. This rise can now be detected by comparing the current value of the envelope curve following function with an earlier value (or a predecessor value corresponding to the earlier value). The comparison can in this case be carried out by subtraction or by quotient formation, it being possible to obtain a so-called "comparison variable" as the result with both procedures. The start of a note is detected as soon as this comparison variable is greater than a threshold value. All the other signal changes, including those which lead to a temporary increase in the amplitude, are separated out. Since the amplitude is now no longer evaluated per se, but an amplitude jump or an amplitude ratio, it becomes possible to define the start of a note largely independently of its volume.

In this case, it is particularly preferred for a check to be carried out to determine whether the envelope curve following function rises still further, in particular before the threshold value comparison. This improves the accuracy of detection of the start of a note. The point where the first oscillation reaches its maximum after being plucked is widely regarded as the start of a note. This maximum value can still also be recognized in the envelope curve following function. However, the rise now starts slightly earlier. In practice, three points in time are used in this type of evaluation, namely one in the past, one current point and one in the future. If it is found that the current value of the envelope curve following function is the largest of the three values, the maximum has been reached. In this case, the start of a note can be defined. If the future value is still greater than the current value, one knows that the start of the note will occur shortly, but it has still not been reached. One cannot of course see into the future. In the case of a technical implementation, the last value and the last but one value of the envelope curve following function are thus considered, starting from the real current value, and the last value for the current method is used as the current value, the last but one as the last value, and the real current value as the future value. In consequence, the evaluation admittedly lags behind the current note production by a short period of time. However, this is only a few milliseconds in this case, which are of no consequence because most of the following evaluation algorithms require even more time anyway.

The comparison value is preferably determined at constant time sections. It is possible to limit this process to subtraction because it relates only to the ratio of the individual comparison values to one another, but not to absolute values.

A minimum value function is advantageously formed from the envelope curve following function, and the comparison value is formed from the envelope curve following function and the minimum value function. If only values on the envelope curve following function are now compared with one another, it is possible under unfavorable circumstances for values which do not differ significantly from one another to be determined in the case of appropriate intervals between the individual points in time, for example if the time interval between two values is too small. If, on the other hand, the time intervals between individual values are too large, it is possible for a rise in a rapid sequence of notes not to be recognized. The minimum value function now reflects the actual energy in the oscillating string, without being disturbed by signal spikes. If the minimum value function is now used to form the comparison value, for example forms a difference between a value of the envelope curve following function and a value of the minimum value function, one is sure that the rise in the envelope curve following function can be detected correctly in every case. The minimum value function can be formed, for example, by its initial value being made equal to that of the envelope curve following function. If the value of the envelope curve following function falls below this value, the value of the minimum value function is correspondingly reduced. Otherwise, it remains constant. When the start of a note is found, the value of the minimum value function increases again to the value of the envelope curve following function at this point in time.

It is in this case particularly preferred for the comparison value to be formed from values of the envelope curve following function and the minimum value function which apply at the same point in time. This very considerably simplifies the administration of the individual values, and complicated indexing of the individual values is avoided. The smallest signal value before the start of a new note is found with the aid of the minimum value function without having to determine its point in time separately.

The knowledge that the minimum value function can rise only at the start of a new note and is a relatively smooth function which cannot change its values quickly, can be advantageously further made use of by the minimum value function being determined at intervals which are greater in time by a multiple than the values of the envelope curve following function. In consequence, computation time and evaluation time are in turn saved.

In order to form the envelope curve following function, a maximum magnitude of the audio signal is advantageously determined, from which the envelope curve following function decays until the audio signal becomes greater again than the envelope curve following function, in this case the envelope curve following function following the audio signal until the maximum value is reached. Such an envelope curve following function can be found, for example, at the output terminals of a capacitor which is connected in parallel with a rectifier. Such an envelope curve following function can, of course, also be produced numerically or digitally in a relatively simple manner.

In this case, it is particularly preferred for the envelope curve following function to decay exponentially. Such a behavior can be implemented digitally very easily by two operations, namely on the one hand by a comparison and on the other hand by the reduction of the value by a fraction of its value. If the comparison shows that the actual amplitude of the audio signal is greater than the envelope curve following function, the actual amplitude is used as the envelope curve following function. If this is not the case, the envelope curve following function is decremented by a small value. The decrement can be formed by a "shift right" operation, that is to say shifting the bits to the right by a predetermined number of digits, which corresponds to division by a power of the number 2, for example 1/128 . . . 1/512. The actual decrementing is then carried out by subtraction.

The audio signal is preferably subjected to full-wave rectification before the formation of the envelope curve following function. In this case, not only the positive amplitude values but also the negative amplitude values are available as an information source.

A very particularly preferred refinement provides for the threshold value to be varied dynamically as a function of the audio signal. An increase in the dynamic range admittedly already occurs as a result of the transition from the amplitude of the audio signal to a comparison value of the envelope curve following function. However, this dynamic range can be still further increased by varying the threshold value as a function of the audio signal, in particular as a function of its amplitude. Thus, for example, the threshold value can be reduced when playing very quietly and increased when playing very loudly.

It is in this case advantageous for the threshold value to have an element with a constant value as the minimum value. This minimum value keeps the influence of disturbances during a pause in playing low.

A variable element of the threshold value is preferably formed by a decay function which decays from a value which is set, on the detection of the start of the preceding note, to the amplitude of the envelope curve following function or of a value which is proportional thereto. In the event of an increase in volume, the threshold value is thus immediately raised or increased. In the event of a reduction in volume, it admittedly takes a certain amount of time until the threshold value is so small that even relatively quiet signals can be reliably detected. However, this can be accepted without any further problems since, in musical terms, although there are no problems in changing suddenly from pianissimo to fortissimo, the converse change from fortissimo to pianissimo always requires a certain amount of time, however, musically and from the sensation of the listener.

The decay function advantageously decays to half its value in a range from 200 to 600 ms. When selecting such a decay response, the transition from loud to quiet is still found to be acceptable.

In a very particularly preferred refinement, a filter envelope curve following function and a filter minimum value function are formed from a low-pass-filtered audio signal. Such a filter signal reproduces a "smoothed" volume of the guitar string. The cut-off frequency of the low-pass filter is in this case approximately three times the fundamental frequency of the string. Such filtered functions allow further effects to be achieved, which are discussed further below.

It is in this case particularly preferred for a positive and a negative envelope curve following function to be formed initially, and for the filter envelope curve following function to be formed from the sum of the positive and negative envelope curve following functions. While full-wave rectification can be used in the case of the envelope curve following function, it is more favorable in the case of the filter envelope curve following function to use values which reproduce a peak to peak signal. In this way, the influence of direct-current offsets is precluded. Such offsets result, for example, in the case of a so-called "hammer-on" on the guitar, that is to say a change to a higher fret on the guitar without striking the string again. Specifically, when such a change occurs, the string is moved closer to the pickup which, in the case of an electromagnetic pickup, for example, leads to an asymmetric offset of the audio signal. Since, however, the filter envelope curve following function is an expression of the interval between the peaks of the filtered audio signal, this direct-current offset is irrelevant.

A comparison value can advantageously be determined in an appropriate manner from the filter envelope curve following function, the start of a note being defined only when the filter envelope curve following function likewise shows a significant rise. In consequence, disturbances are also precluded which can result, for example, from the fingers of the left hand being lifted off the string shortly after the string has been struck. Specifically, the string is in this case given a "vertical" oscillation, that is to say an oscillation in the direction of the guitar body. This oscillation leads to narrow peaks with a high amplitude in the audio signal, which is relatively "round" otherwise in the decay phase with a low harmonic content. Such disturbances are precluded relatively easily using the filter envelope curve following function.

A further field of application of the envelope curve following function is the definition of the end of a note, which is preferably defined when the value of the filter envelope curve following function is less than the value of the filter minimum value function or of a value proportional thereto at a point which is earlier in time by a predetermined interval. The end of a note can admittedly be found in a simple manner by the audio signal falling below a predetermined threshold value. However, it is not possible to reproduce staccato playing using this process. Such staccato playing is often produced by the fingers of the left hand being lifted somewhat off the string. This behavior also leads to a change in the distance between the string and the pickup, with the effects already discussed. The problems which occur can be largely overcome by the use of the filter envelope curve following function and its corresponding filter minimum value function.

The invention also relates to a method for recognition of the end of a note in the case of percussion or plucked musical instruments, in the case of which a filter envelope curve following function and a filter minimum value function are formed from a low-pass-filtered audio signal, a positive and a negative envelope curve following function being formed initially, the filter envelope curve following function being formed from the sum of the positive and negative envelope curve following functions, and the end of the note being defined when the value of the filter envelope curve following function is less than the value of the filter minimum value function or a value proportional thereto at a point which is earlier in time by a predetermined interval.

BRIEF DESCRIPTION OF THE DRAWINGS

The invention is described in the following text with reference to a preferred exemplary embodiment in conjunction with the drawing, in which.

DESCRIPTION OF PREFERRED EMBODIMENTS

Figure 1:
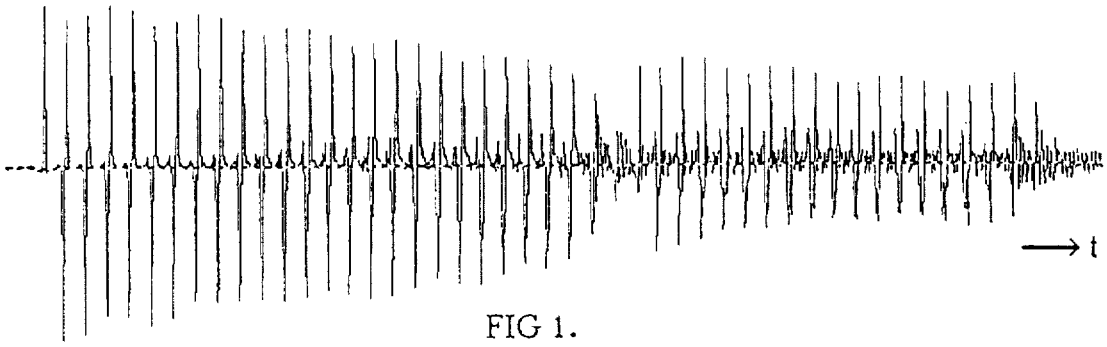
FIG. 1 shows the waveform of an audio signal.

FIG. 1 shows the waveform of an audio signal in the time domain, this signal being produced by an oscillating guitar string after it has been plucked or struck. The following description has been produced on the basis of an individual guitar string. In reality, however, the method is carried out for all the strings of a guitar, it being possible for certain method steps to be used jointly for all the strings.

The audio signal which is illustrated in FIG. 1 is initially rectified, to be precise using full-wave rectification. The resultant signal waveform is illustrated in FIG. 2.

Figure 2:
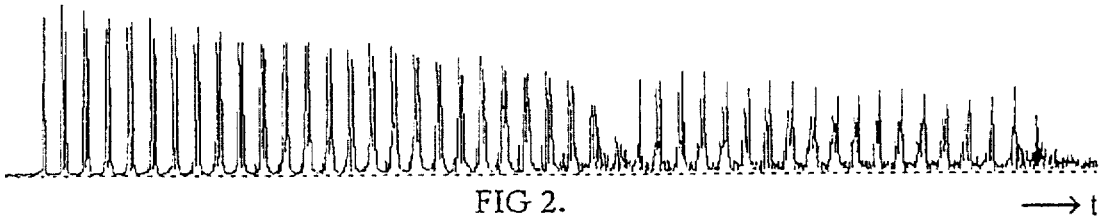
FIG. 2 shows the rectified audio signal.
Figure 3:
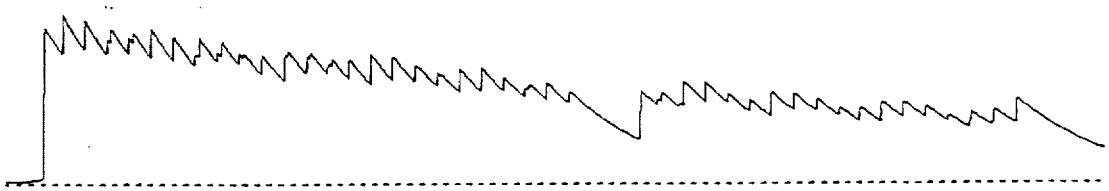
FIG. 3 shows an envelope curve following signal.

An envelope curve following function, which can be seen in FIG. 3, is formed from the signal waveform illustrated in FIG. 2. Such an envelope curve following function can be produced relatively easily. The initial values of the envelope curve following function correspond to the initial values of the rectified audio signal. As long as the audio signal is rising, that is to say the current value is greater than the last value or previous value, the value of the envelope curve following function is set to the value of the audio signal. If this is not the case, the value of the envelope curve following function is reduced. The reduction can be carried out by the last value of the envelope curve following function being multiplied by a constant factor <1. In order to avoid a floating point operation, the last value of the envelope curve following function can alternatively be reduced by a fraction thereof, it being possible to produce this fraction by a "shift right" operation (represented by ">>x", where x indicates the number of digits through which the shift operation is carried out). In this case, the bits in the binary representation of the corresponding value are shifted to the right by a specific number of digits, which corresponds to division by a power of 2,that is to say, for example, 1/128 . . . 1/512. In consequence, the envelope curve following function decays exponentially between two peak values of the audio signal. The digital representation of the individual values must, of course, have an appropriate number of bits for the "shift right" operation to be possible to the desired extent.

Figure 4:
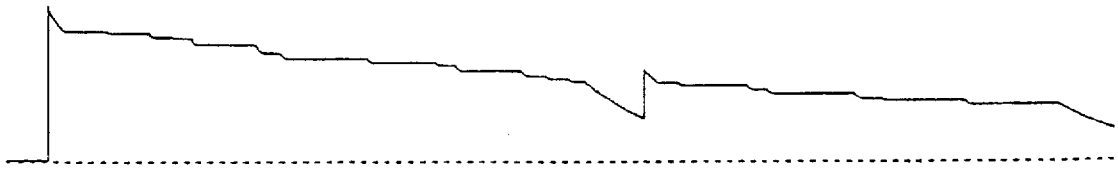
FIG. 4 shows a minimum value function.

FIG. 4 illustrates a minimum value function of the envelope curve following function. This minimum value function is formed by its start value being set to the start value of the envelope curve following function. After this, the minimum value function is changed only when the value of the envelope curve following function falls below the value of the minimum value function. In this case, the value of the minimum value function is set to the smaller value.

If the current value of the audio signal, which generally exists as a sample, is called AMP, the current value of the envelope curve following function is called ENV and the current value of the minimum value function is called ENVMIN, then this situation can be represented as follows, IF AMP>ENV
ENV=AMP
ELSE IF AMP<−ENV
ENV=−AMP
(this corresponds to full-wave rectification)
ELSE
ENV=ENV−ENV>>9
IF ENV<ENVMIN
ENVMIN=ENV
END IF.

A comparison value VW is now determined from the values of the envelope curve following function and the minimum value function in accordance with the following equation, $$VW=ENV-C1\times ENVMIN$$

In this case, C1 is a constant which is close to 2. A quotient can also be formed instead of a difference.

This comparison value can now be used to make a statement as to whether this is the start of the note or any other rise in the envelope curve following function. To this end, the comparison value is compared with a threshold value which is composed of two parts. On the one hand, the threshold value has a relatively small, constant element THR. On the other hand, the threshold value contains a dynamically variable element CTRENV, which is described by a decay function. The decay function decays exponentially. Its start value is set to the value of the envelope curve following function when the start of a note is recognized, to be precise without any major time delay, that is to say at the latest at the next clock step. Otherwise, CTRENV is decremented at predetermined time intervals in accordance with the following equation $$CTRENV=CTRENV-CTRENV>>C2$$

where C2 is selected such that CTRENV falls to half its value within a range of 200 to 600 ms. The decrementing is carried out approximately every 26 ms with clock times of 10 kHz. This function is also called a control envelope curve. It can be seen that, when the volume is changed from quiet to loud, that is to say in the case of the string being strongly excited, the start value of CTRENV is immediately increased, so that matching to loud sounds takes place very quickly. If the string is struck quietly after being struck loudly, the sensitivity is reduced only when a certain time delay has elapsed, namely within the range mentioned above of a few hundred milliseconds. However, this delay can be tolerated without any problems since it is relatively small and, although a musical performance may include very fast changes from very quiet to loud, a certain "flowing" transition can always be observed, however, during the transition from loud to quiet. It is assumed that this is related to the physiological characteristics of the human ear.

These two elements are used to form the dynamic threshold value:

$$DYNTHR=THR+C3\times CTRENV,$$

where C3 is a further constant close to 1.

The start of a note can be detected when:

$$VW>DYNTHR.$$

or, expressed in a different way:

$$ENV>C1\times ENVMIN+THR+C3\times CTRENV.$$

It can easily be seen that, in the case of this procedure, the start of a note can be defined reliably in a relatively large dynamic range because individual variables change dynamically in the course of play. The overall change in the expression of the right-hand side is, however, not proportional to the volume. In the case of relatively quiet sounds, the THR and CTRENV element is of greater significance.

In the present method, a check is carried out before this comparison to determine whether the envelope curve following function is or is not still rising. If it is still rising, that is to say its values are increasing, this comparison is not carried out.

Using this procedure, the start of a note can be recognized with a high level of reliability. However, errors can occur in specific situations under unfavorable circumstances. A typical case is the so-called "hammer on" when the player shortens the string while the string is oscillating, that is to say slides his or her finger to a higher fret or presses the string down on this higher fret. Specifically, the string becomes much closer to the pickup in this case, the pickup being designed as an electromagnetic pickup as a rule, so that a signal change is produced without this change having been brought about by striking or hitting the string. In order to be able to preclude such incorrect information reliably, the audio signal is additionally low-pass-filtered once first of all, a low-pass filter being used whose cut-off frequency is approximately three times greater than the fundamental frequency of the string. The current value of this filtered audio signal is called FAMP. A positive envelope curve following signal PFENV and a negative envelope curve following signal NFENV are obtained from this. The filter envelope curve following signal FENV is then formed from the sum of the values of these two envelope curve following signals, which can be denoted in formal terms as follows:

IF FAMP>PFENV
PFENV=FAMP
ELSE IF FAMP<−NFENV
NFENV=−FAMP
ELSE
PFENV=CF×PFENV
NFENV=CF×NFENV
ENDIF
FENV=PFENV+NFENV where CF is a constant factor.

A filter minimum value function FENVMIN is formed from this filter envelope curve following function, in accordance with the following instruction

IF FENV<FENVMIN
FENVMIN=FENV
ENDIF

The calculation of FENVMIN need not be carried out for each sample. It is sufficient to carry it out, for example, for every 128th sample.

The two last-mentioned functions can be used to construct a further decision criterion as to whether this is or is not the start of a note. This is done by following the waveform of FENVMIN in a plurality of successive time slots. In this case, the smallest value of two successive time slots is used. If this value, which we will call TMP_FENVMIN, or a value proportional to it is less then FENV, then the start of a note has been found. At the same time, account is taken of the fact that, in certain playing conditions, for example the "hammer-on" mentioned above or else when a string is released immediately after it has been struck, disturbance signals occur which admittedly have a large amplitude, but only a short duration. Such disturbances are eliminated by the filter envelope curve following function.

The filter envelope curve following function can also be used in order to detect the end of a note. For the end of a note there is, first of all, the option of waiting until the amplitude of the audio signal or the envelope curve following function has fallen below a specific threshold value. However, this does not allow staccato playing to be reproduced reliably. The sounds are then admittedly played in a staccato manner. However, this cannot be recognized directly. Nevertheless, if values of the filter minimum value function are compared with one another at predetermined intervals, one quickly determines whether this is or is not staccato playing. If, for example:

$$C4 \times FENV < FENVMIN3$$

then the sound has ended, to be precise by staccato playing. FENVMIN3 is in this case the value of FENVMIN approximately 32 to 45 ms before. C4 is a constant with a typical value of 15/4.

Figure 5:
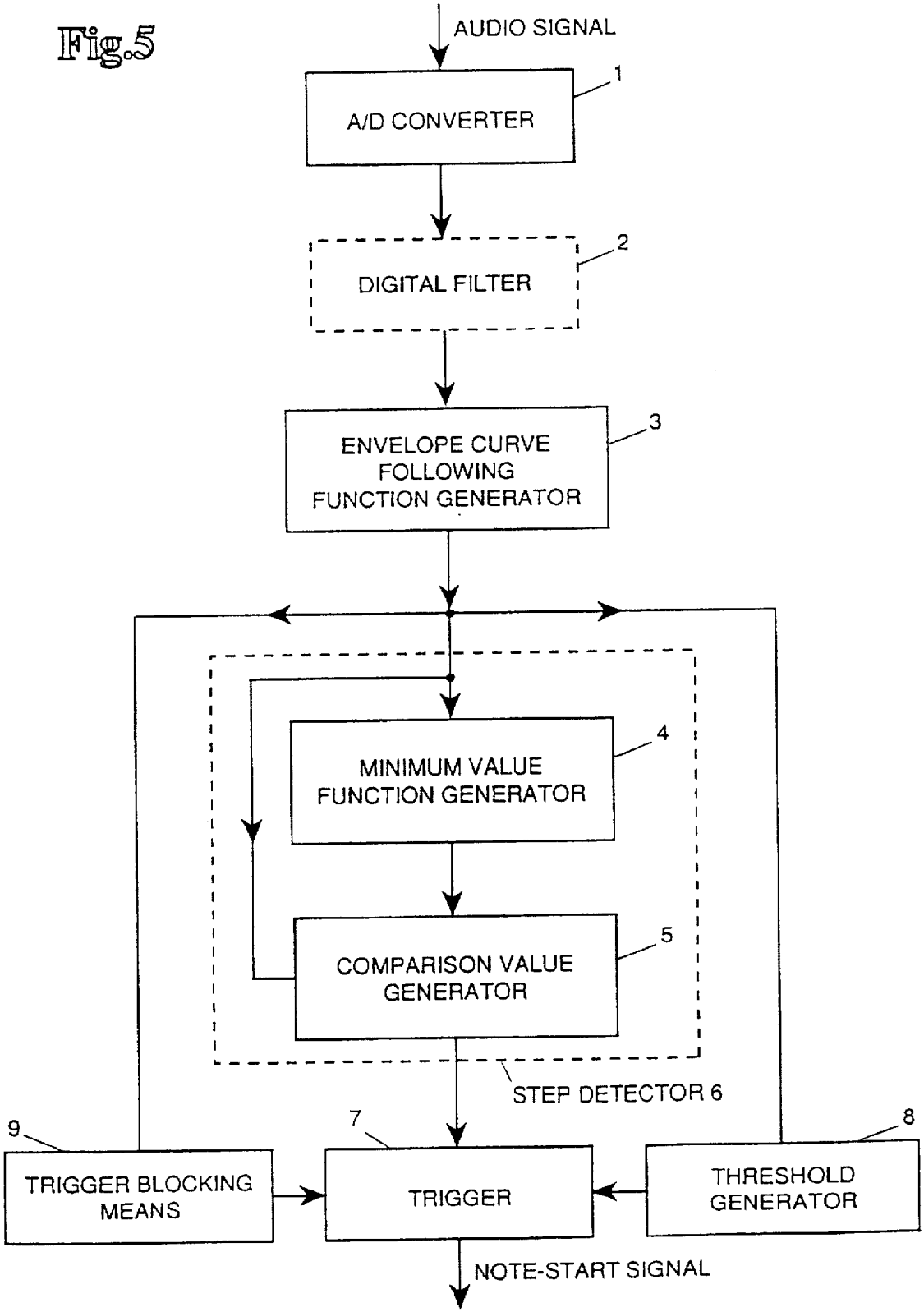
FIG. 5 shows a schematic block diagram of an apparatus according to the invention.

FIG. 5 shows a schematic block diagram of an apparatus according to the invention. The apparatus comprises an A/D converter 1, optionally a digital filter 2, an envelope curve following function generator 3, a step detector 6 consisting of a minimum value function generator 4 and a comparison value generator 5, a trigger 7, a trigger blocking means 9 and a threshold generator 8.

An audio signal as shown in FIG. 1, generated from the pickup of a guitar for example, is fed to the A/D converter 1 where it is sampled at a constant sampling rate and a digital output signal is produced. This output signal may be filtered in filter 2 in order to remove disturbing higher harmonics, if necessary. The filtered signal is channelled into the envelope curve following function generator 3 in order to generate an envelope curve following function, which is exemplified in FIG. 3. The generation of said envelope curve following function includes a full wave rectification of said digital signal and is done according to the following algorithm, in which the current value of the audio signal, which generally exists as a sample, is called AMP and the current value of the envelope curve following function is called ENV:

```
IF AMP>ENV
ENV=AMP
ELSE IF AMP<-ENV
ENV=-AMP (this corresponds to full-wave rectification)
ELSE
ENV=ENV-ENV>>9
```

The minimum value function generator forms a minimum value function ENVMIN as shown in FIG. 4. This minimum value function is formed by its start value being set to the start value of the envelope curve following function. After this, the minimum value function is changed only when the value of the envelope curve following function falls below the value of the minimum value function. In this case, the value of the minimum value function is set to the smaller value. This can be represented by the following algorithm:

```
IF ENV<ENVMIN
ENVMIN=ENV
ENDIF
```

A comparison value VW is formed in comparison value generator 5 from the values of the envelope curve following function and the minimum value function in accordance with the following equation:

$$VW = ENV - C1 \times ENVMIN$$

where C1 is a constant.

Simultaneously the output of said envelope curve following function generator 3 is supplied to threshold generator 8 which produces a dynamic threshold DYNTHR based on the following formula:

$$DYNTHR = THR + C3 \times CTRENV,$$

where C2, C3 and THR are constant values and CTRENV is defined as:

$$CTRENV = CTRENV - CTRENV >> C2$$

THR is a first component constant in time and C3×CTRENV is a second time varying component of said dynamic threshold DYNTHR. Said second component is set to the value of the envelope curve following function when the start of a note is recognised and is decremented at predetermined time intervals.

Trigger 7 generates a note-start signal if said dynamic threshold DYNTHR exceeds said comparison value VW, provided that it is not blocked by trigger blocking means 9. The latter is the case if said envelope curve following function is still further rising, which is detected by said trigger blocking means 9.

By the use of the digital filter 2, the apparatus shown in FIG. 5 can also be used for the recognition of the end of a note with a high level of reliability. The audio signal is therefor additionally low-pass-filtered once first of all, said low-pass filter 2 having a cut-off frequency approximately three times greater than the fundamental frequency of the string. The current value of this filtered audio signal is called FAMP, from which filtered audio signal FAMP the envelope curve following function generator 3 forms a positive envelope curve following function signal PFENV and a negative envelope curve following function signal NFENV.

In the envelope curve following function generator 3, the filter envelope curve following function signal FENV is then formed from the sum of the values of these two envelope curve following function signals PFENV and NFENV. In formal terms, this can be denoted as the following algorithm:

```
IF FAMP>PFENV
PFENV=FAMP
ELSE IF FAMP<-NFENV
NFENV=-FAMP
ELSE
PFENV=CF×PFENV
NFENV=CF×NFENV
ENDIF
FENV=PFENV+NFENV
```

where CF is a constant factor.

In the minimum value function generator 4, a filter minimum value function signal FENVMIN is formed from said filter envelope curve following function signal FENV, in accordance with the following instruction:

```
IF FENV<FENVMIN
```

FENVMIN=FENV

ENDIF

The calculation of said filter minimum value function signal FENVMIN in the minimum value function generator 4 need not be carried out for each sample. It is sufficient to carry it out, for example, for every 128th sample.

The end of the note is defined in the comparison value generator 5, which generates a comparison value between the value of the filter envelope curve following function signal FENV and the value of the filter minimum value function signal FENVMIN or a value proportional thereto at a point which is earlier in time by a predetermined interval. In the embodiment of FIG. 5, the end of the note is defined when the value of said filter envelope curve following function signal FENV is less than the value of said filter minimum value function signal FENVMIN or the value proportional thereto at the point which is earlier in time by the predetermined interval.

For detecting the end of a note there is also the option of waiting until the amplitude of the audio signal or the envelope curve following function has fallen below a specific threshold value. However, this does not allow staccato playing to be reproduced reliably. The sounds are then admittedly played in a staccato manner. However, this cannot be recognized directly. Nevertheless, if values of the filter minimum value function are compared with one another at predetermined intervals, as described hereinabove, one quickly determines whether this is or is not staccato playing. If, for example:

$$C4 \times FENV < FENVMIN3$$

then the sound has ended, to be precise by staccato playing. FENVMIN3 is in this case the value of FENVMIN approximately 32 to 45 ms before. C4 is a constant with a typical value of 15/4.

Having thus described the principles of the invention together with several illustrative embodiments thereof, it is to be understood that although specific terms are employed, they are used in a generic and descriptive sense, and not for purposes of limitation, the scope of the invention being set forth in the following claims:

We claim:

1. A method for recognition of the start of a note in the case of percussion or plucked musical instruments, comprising the steps of:

providing an audio signal from the musical instrument;

forming an envelope curve following function from the audio signal, forming a comparison value from a current value of the envelope curve following function and a predecessor value corresponding to an earlier value of the envelope curve following function, and providing a start of a note signal at a point in time at which the comparison value exceeds a threshold value.

2. The method as claimed in claim 1, wherein a check is carried out to determine whether the envelope curve following function rises still further, in particular before the threshold value comparison.

3. The method as claimed in claim 1, wherein the comparison value is determined in constant time sections.

4. The method as claimed in claim 1, wherein a minimum value function is formed from the envelope curve following function, and the comparison value is formed from the envelope curve following function and the minimum value function.

5. The method as claimed in claim 4, wherein the comparison value is formed from values of the envelope curve following function and the minimum value function which apply at the same point in time.

6. The method as claimed in claim 5, wherein values of the minimum value function are determined at intervals which are greater in time by a multiple than the values of the envelope curve following function.

7. The method as claimed in claim 1, wherein a maximum magnitude of the audio signal is determined in order to form the envelope curve following function, from which maximum magnitude the envelope curve following function decays until the audio signal becomes greater again than the envelope curve following function, in this case the envelope curve following function following the audio signal until the maximum value is reached.

8. The method as claimed in claim 7, wherein the envelope curve following function decays exponentially.

9. The method as claimed in claim 1, wherein the audio signal is subjected to full-wave rectification before the formation of the envelope curve following function.

10. The method as claimed in claim 9, wherein the threshold value is varied dynamically as a function of the audio signal.

11. The method as claimed in claim 10, wherein the threshold value has an element with a constant value as the minimum value.

12. The method as claimed in claim 10, wherein a variable element of the threshold value is formed by a decay function which decays from a value which is set, in response to a prior start of note signal, to the amplitude of the envelope curve following function or of a value which is proportional thereto.

13. The method as claimed in claim 12, wherein the decay function decays to half its value in a range from 200 to 600 ms.

14. The method as claimed in claim 1, wherein a filter envelope curve following function and a filter minimum value function are formed from a low-pass-filtered audio signal.

15. The method as claimed in claim 14, wherein a positive and a negative envelope curve following function are formed initially, and the filter envelope curve following function is formed from the sum of the positive and negative envelope curve following functions.

16. The method as claimed in claim 14, wherein a comparison value is determined from the filter envelope curve following function, the start of a note being defined only when the filter envelope curve following function likewise shows a predetermined rise.

17. The method as claimed in claim 16, wherein the end of a note is defined when the value of the filter envelope curve following function is less than the value of the filter minimum value function or of a value proportional thereto at a point which is earlier in time by a predetermined interval.

18. A method for recognition of the end of a note in the case of percussion or plucked musical instruments, comprising the steps of:

providing a low-pass-filtered audio signal from the musical instrument;

forming a filter envelope curve following function and a filter minimum value function from the low-pass-filtered audio signal, the forming step comprising forming a positive and a negative envelope curve following function and forming the filter envelope curve following function from the sum of the positive and negative envelope curve following functions, and providing an end of the note signal when the value of the filter envelope curve following function is less than the value of the filter minimum value function or a value proportional thereto at a point which is earlier in time by a predetermined interval.

19. Apparatus for recognition of the start of a note of a musical instrument producing a sound which is represented by an audio signal varying in time, said apparatus comprising:

(a) means for generating an envelope curve following function for said audio signal;

(b) step detector means for detecting an upward step having a certain magnitude in said envelope curve following function;

(c) threshold generator means for generating a threshold;

(d) trigger means for outputting a note-start signal, if said magnitude of said detected upward step exceeds said threshold.

20. The apparatus according to claim 19, wherein said step detector means include (a) minimum value function generator means generating a minimum value function on the basis of said envelope curve following function;

(b) comparison value generating means generating a comparison value which is indicative of a degree of deviation between a current value of said minimum value function and a current value of said envelope curve following function.

21. The apparatus according to claim 19, wherein said means for generating an envelope curve following function generates said envelope curve following function according to the following algorithm: each time a current value of said audio signal is larger than a current value of said envelope curve following function said envelope curve following function is increased up to said current value of said audio signal and decays otherwise.

22. The apparatus according to claim 19, wherein said threshold generator means generates a threshold having a first component which is constant in time and a second component which decays.

23. The apparatus according to claim 22, wherein said second component of said threshold decays starting from a value which is set, on the detection of a start of a preceding note, to the amplitude of said envelope curve following function or a value which is proportional thereto.

24. The apparatus according to claim 19, wherein said means for generating an envelope curve following function include rectifier means for subjecting said audio signal to a full-wave rectification.

25. The apparatus according to claim 20, wherein said means for generating an envelope curve following function include filter means for filtering said audio signal, from which filtered audio signal a filter envelope curve following function is formed in said means for generating an envelope curve following function and a filter minimum value function is formed in said minimum value function generator means.

26. The apparatus according to claim 25, wherein said means for generating an envelope curve following function form a positive and a negative envelope curve following function, said filter envelope curve following function being formed from the sum of said positive and negative envelope curve following functions.

27. The apparatus according to claim 25, wherein said comparison value generating means generates a comparison value between the value of said filter envelope curve following function and the value of said filter minimum value function or a value proportional thereto at a point which is earlier in time by a predetermined interval, said comparison value being indicative of the end of a note.

28. The apparatus according to claim 27, wherein the end of a note is defined when said value of said filter envelope curve following function is less than said value of said filter minimum value function or of said value proportional thereto at said point which is earlier in time by said predetermined interval.

* * * * *